US009688370B1

(12) United States Patent
Shiue

(10) Patent No.: US 9,688,370 B1
(45) Date of Patent: Jun. 27, 2017

(54) INFLATOR FOR INFLATABLE CLOTHING AND INFLATABLE CLOTHING THEREOF

(71) Applicant: Jeff Heng-Wen Shiue, Wujie (TW)

(72) Inventor: Jeff Heng-Wen Shiue, Wujie (TW)

(73) Assignee: SHEI CHUNG HSIN IND. CO., LTD., Wujei (TW)

( * ) Notice: Subject to any disclaimer, the term of this patent is extended or adjusted under 35 U.S.C. 154(b) by 0 days.

(21) Appl. No.: 15/355,001

(22) Filed: Nov. 17, 2016

(51) Int. Cl.

| | |
|---|---|
| ***B63C 9/125*** | (2006.01) |
| ***A41D 1/04*** | (2006.01) |
| ***A41D 3/00*** | (2006.01) |
| ***A41D 19/00*** | (2006.01) |
| ***A41D 13/012*** | (2006.01) |
| *B63C 11/08* | (2006.01) |

(52) U.S. Cl.
CPC ..... *B63C 9/1255* (2013.01); *A41D 1/04* (2013.01); *A41D 3/00* (2013.01); *A41D 13/0125* (2013.01); *A41D 19/00* (2013.01); *B63C 2011/085* (2013.01)

(58) Field of Classification Search
CPC ..... B63C 9/1255; A41D 1/04
USPC ..... 441/99–106
See application file for complete search history.

(56) References Cited

U.S. PATENT DOCUMENTS 6,659,689 B1 * 12/2003 Courtney ..... B63C 9/08 2/2.17
6,805,519 B1 * 10/2004 Courtney ..... B63C 9/08 405/185
7,854,568 B2 * 12/2010 Ekuan ..... B63C 11/02 405/186
8,595,864 B2 * 12/2013 Orita ..... A41D 13/018 2/102

* cited by examiner

*Primary Examiner* — Lars A Olson
*Assistant Examiner* — Jovon Hayes

(57) ABSTRACT

An inflator includes a cover hingedly formed on an inflatable clothing, an air-port seat formed under the cover having an air port formed through the air-port seat, and a self-restoring check valve hingedly formed under the air-port seat for normally elastically closing the air port as subjected to air pressure in the inflatable clothing, whereby upon opening of the cover, air can be blown into the inflatable clothing through the air port and to open the check valve to inflate the clothing for keeping warm or buoyant for the clothing wearer.

17 Claims, 3 Drawing Sheets

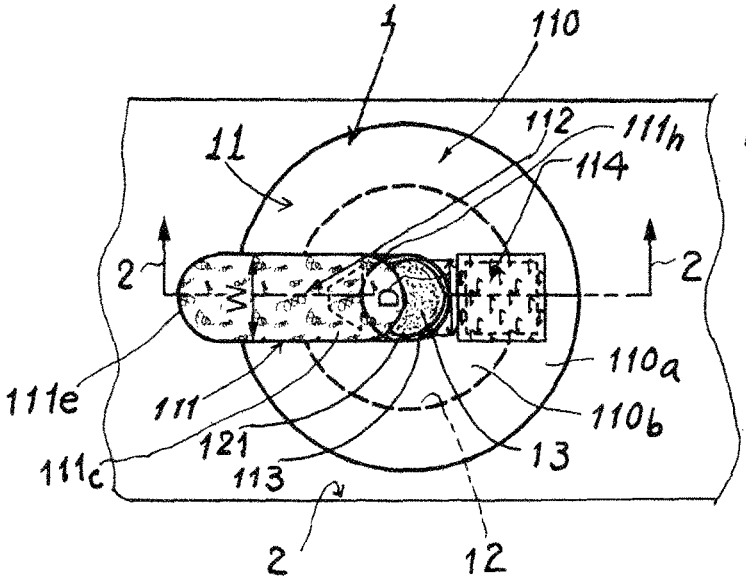
Fig. 1
Fig. 2
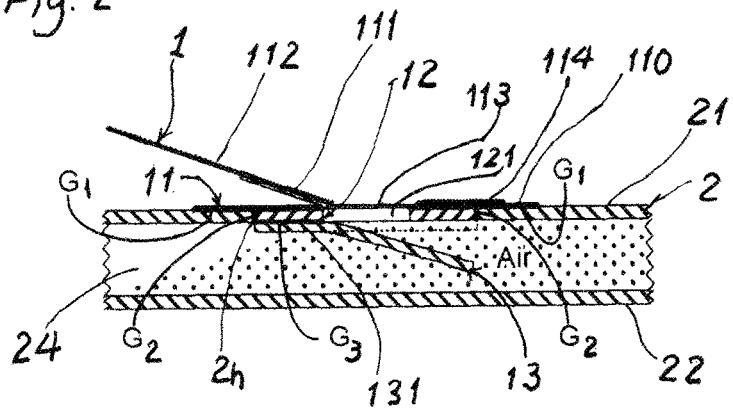
Fig. 3
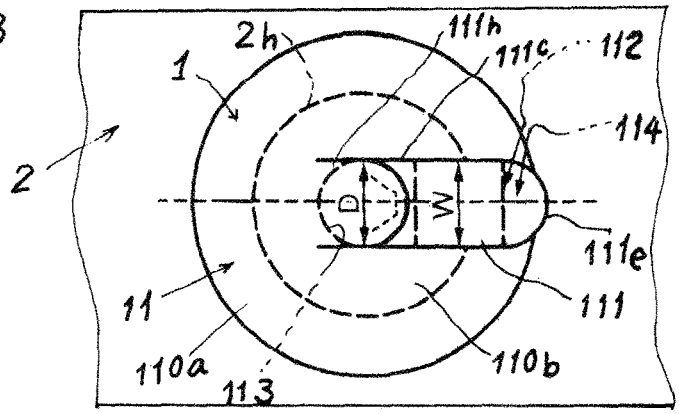

INFLATOR FOR INFLATABLE CLOTHING AND INFLATABLE CLOTHING THEREOF

BACKGROUND OF THE INVENTION

U.S. Pat. No. 9,067,658 disclosed an inflatable swim vest including an inflator mechanism operatively connected to a charged gas canister and to the inflatable bladder. In an emergency situation while swimming, a handle can be grasped to pull a rip cord to trigger the inflator mechanism to dispel the contents of the gas canister into the bladder for inflating the vest for safety.

However, such a conventional inflatable vest has the following drawbacks:

1. A gas canister and inflator mechanism should be provided in the vest to increase the production complexity and cost of the vest. Also, the vest as thus implemented will become heavy, clumsy and uncomfortable for a wearer.
2. Even a manually operated inflator (numerals 90, 91 of the prior art) is provided for orally inflating the bladder, a flexible or swingable tube (numeral 91) is still needed, which may obstruct or tangle the wearer's movement.

It is therefore expected to invent a thin, light and cost-reduced inflator and the clothing thereof.

SUMMARY OF THE INVENTION

The object of the present invention is to provide an inflator including a cover hingedly formed on an inflatable clothing, an air-port seat formed under the cover having an air port formed through the air-port seat, and a self-restoring check valve hingedly formed under the air-port seat for normally elastically closing the air port as subjected to air pressure in the inflatable clothing, whereby upon opening of the cover, air can be blown into the inflatable clothing through the air port and to open the check valve to inflate the clothing for keeping warm or buoyant for the clothing wearer.

Another object of the present invention is to provide an inflatable clothing including inflatable vest, sports wear, life vest, diving vest or vest for keeping the wearer warm in cold weather, having the inflator implemented in the vest.

BRIEF DESCRIPTION OF THE DRAWINGS

FIG. 1 is a top view illustration of the inflator of the present invention.

FIG. 2 is a sectional drawing as viewed from 2-2 direction of FIG. 1.

FIG. 3 is a top view of the present invention when closed.

DETAILED DESCRIPTION

As shown in FIGS. 1-5, the present invention comprises an inflator 1 and an inflatable clothing 2 implemented with the inflator 1 in the clothing 2.

Figure 4:
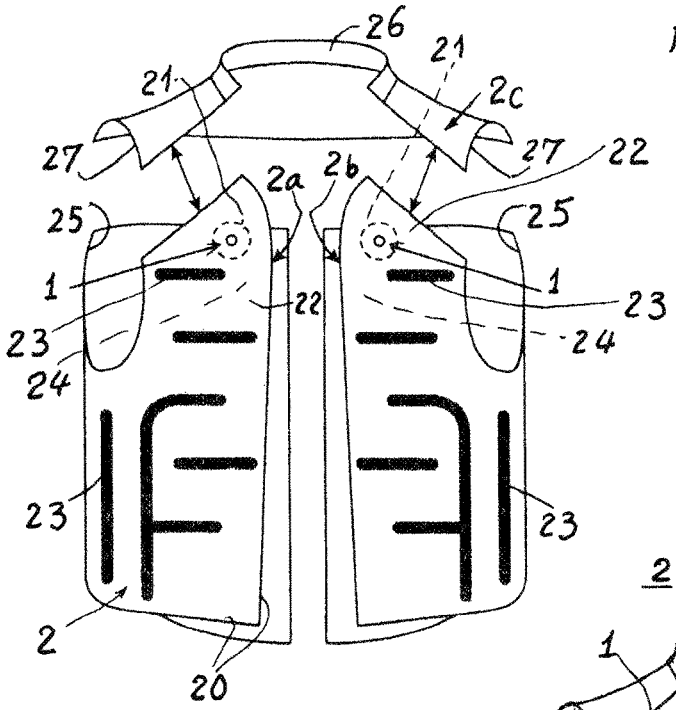
FIG. 4 shows an exploded view of a vest as made by three pieces in accordance with the present invention.
Figure 5:
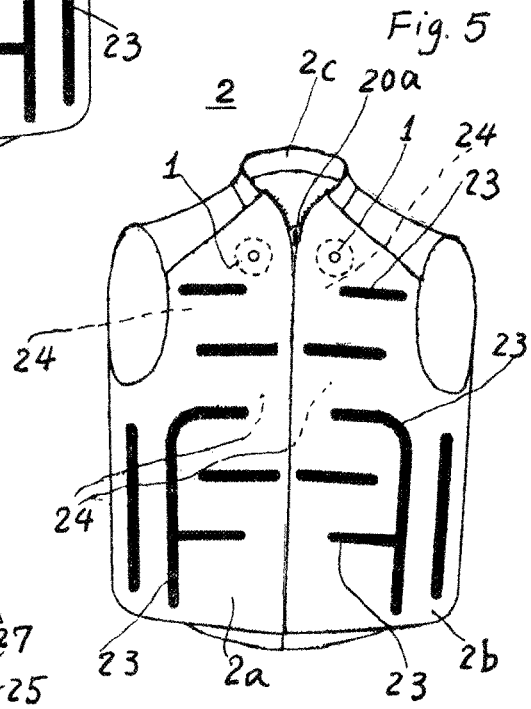
FIG. 5 shows the vest as assembled from FIG. 4.
Figure 11:
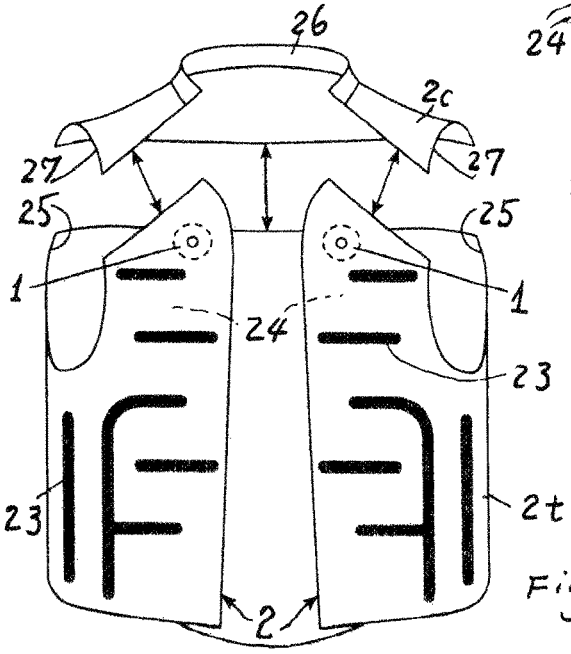
FIG. 11 shows a vest made with two pieces according to the present invention.

The inflatable clothing 2 may include: a vest, a glove, a footwear or any clothing, jacket, apparel or garment, which is inflatable by implementing the inflator 1 in the clothing. FIGS. 4, 5 and 11 as shown in the present invention give an example of inflatable vest, which may be an inflatable sports wear, an inflatable warming vest, an inflatable swimming vest, an inflatable diving vest or an inflatable life vest, not limited in the present invention.

The inflator 1 of the present invention comprise: a cover assembly 11; an air-port member 12; and a self-restoring check valve 13.

The self-restoring check valve 13 is an essential element of the inflator 1 of the present invention and is formed as a flat elastic member, which may be an elastic sheet, plate, film, disk or flapper, adapted to close the holes or openings formed through the air-port member 12, and the cover assembly 11.

The cover assembly 11 includes: a base 110 fixed or adhered on the inflatable clothing 2, a covering strap 111 hingedly secured or formed on the base 110, a central hole 113 formed in a central portion through the base 110 of the cover assembly 11, a first fastener 112 including a hooked-thread fastener of a Velcro tape fastener formed on a bottom of the covering strap 111 adapted for closing the central hole 113 when closing the inflator 1, and a second fastener 114 including a looped fastener of a Velcro tape fastener formed on an outer or upper surface of the base 110 and engageable with the first fastener 112 for closing the central hole 113 when closing the inflator 1.

The base 110 includes an outer annular base portion 110*a* fixed or adhered on a first layer 21 of the inflatable clothing or vest 2 adjacent to a mounting hole 2*h* formed through the first layer 21 of the inflatable clothing or vest 2, and an inner base portion 110*b* adhered or secured with the air-port member 2 which is snugly fixed in the mounting hole 2*h* of the clothing 2 by adhesive bonding or other fixing methods.

The air-port member 12 includes an air port 121 formed through the air-port member 12 to be fluidically communicated with the central hole 113 formed through the cover assembly 11 for inflating air into the clothing 2 or deflating air from the clothing 2; and a valve seat 122 disposed around the air port 121 of the air-port member 12 to be closed by the self-restoring check valve 13.

The covering strap 111 of the cover assembly 11 includes: a hinge portion 111*h* formed on the inner annular portion 110*b* adjacent to the central hole 113, a covering portion 111*c* connected or integrally formed with the hinge portion 111*h* adapted to cover the central hole 113 and the air port 121 when closing the inflator 1, and a pulling end 111*e* formed on an outer end portion of the covering strap 111 adapted to be pulled either outwardly or upwardly for opening the inflator 1 or be pulled inwardly or downwardly for closing the inflator 1.

Figure 6:
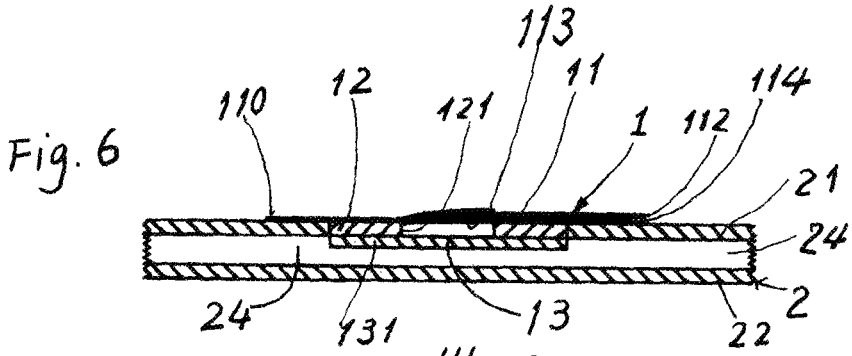
FIG. 6 shows a closed deflated inflator of the present invention.
Figure 9:
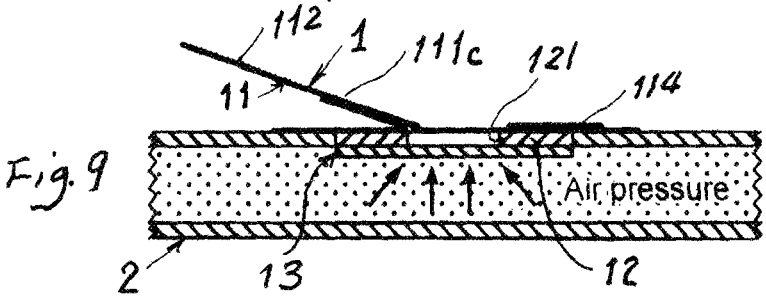
FIG. 9 shows the check valve of the present invention when closed.
Figure 10:
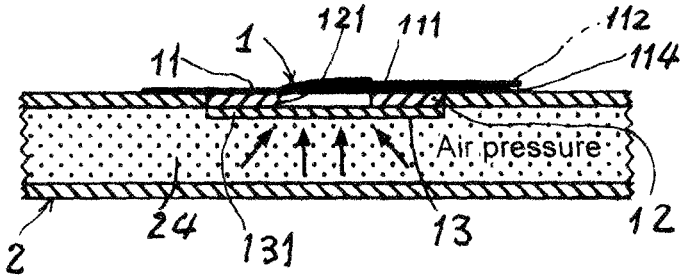
FIG. 10 shows the inflator of the invention when the vest has been inflated.

The self-restoring check valve 13 is formed as an elastic member having an elasticity to be normally restored outwardly or upwardly to close the air port 121 of the air-port member 12 for closing the inflator 1. When the check valve 13 is closed, it will be resiliently contacted with the valve seat 122 of the air-port member 12 to really seal and close the air port 121 as shown in FIGS. 6, 9 and 10.

The self-restoring check valve 13 includes: a fixed portion 131 adhered or secured to the air-port member 12 as projectively positioned under the hinge portion 111*h* of the covering strap 111, and a restoring valve portion 132 having an outer or upper flat surface adapted to close or seal the valve seat 122 of the air-port member 12 when closing the check valve 13.

The check valve 13 may be made of elastomeric materials, including: rubber foam, flexible cellular materials, polychloroprene, plastic sheet (or film), silicon rubber sheet (or film), not limited in this invention; having a self-restoring property so that the check valve may be normally restored outwardly or upwardly to close the air port 121 of the air-port member 12.

The cover assembly 11 may be made of fabric materials as available in textile industry. The air-port member 12 may be made of plastic, rubber or any other suitable materials. The width W of the covering strap 111 may be larger than or equal to the diameter D of the central hole 113. However, the sizes of the elements of this invention are not limited. The central hole 131 may have a same size as that of the air port 121 in the air-port member 12. The check valve 13 should have a size or area larger than the air port 121 in order to well close the air port 121 when closing the check valve 13.

As shown in FIG. 2, the base 110 of the cover assembly 11 is adhered with the first layer 21 of the clothing or vest 2 by glue a adhesive, such as numeral G1, or the base 110 is adhered with the air-port member 12 by the glue/adhesive G as shown in the drawing.

The air-port member 12 is adhered with a periphery of the mounting hole 2*h* as formed in the first layer 21 of the clothing 2 by glue/adhesive such as numeral G2 as shown in FIG. 2.

The fixed portion 131 of the check valve 13 is adhered to the air-port member 12 by glue/adhesive such as numeral G3 as shown in FIG. 2.

Other joining methods, besides adhesive by glue, may also be applied for joining the related elements, such as by stitching or sewing, in the present invention. But, adhesion with glue is the cheapest and most convenient way in this invention.

The Velcro tape fasteners for the first fastener 112 and the second fastener 114 may also be substituted with other fasteners, such as a plug (not shown) sealable in the central hole 113 for closing the inflator 1, not limited in this invention.

The inflatable clothing or vest 2 as shown in FIGS. 4 and 5 includes: a first (or right) torso panel 2*a*, a second (or left) torso panel 2*b*, and a shoulder panel 2*c*, all integrally forming the clothing or vest 2. Each torso panel 2*a*, or 2*b* includes a first layer 21 having a mounting hole 2*h* formed through the first layer 21 adapted for mounting the inflator 1 in the clothing 2, a second layer 22 juxtaposed to the first layer 22 to define an air chamber 24 between the first layer 21 and the second layer 22, a plurality of baffles 23 irregularly or regularly formed in the air chamber 24 and connected between the first layer 21 and the second layer 22, namely forming a solid wall or partition by pressing the first layer 21 and the second layer 22 to form a blockade obstructing or precluding air flow which is filled in the air chamber 24 when inflating the inflator 1 of the present invention, and a closed edge portion 20 circumferentially formed along a circumference of the torso panel 2*a* or 2*b*.

Each torso panel 2*a* or 2*b* further includes: a cuff edge portion 25 cut off at an upper corner side to combinably match a cuff portion 27 of the shoulder panel 2*c*, adapted for passing a wearer's shoulder or arm portion through the cuff portion 27 and the cuff edge portion 25 of the panels 2*a*, 2*b* and 2*c* when assembled.

The shoulder panel 2*c* further includes a collar 26 formed on a central top portion of the shoulder panel 2*c*, adapted for protecting the wearer's neck portion.

After integrating the two torso panels 2*a*, 2*b* and the shoulder panel 2*c* by adhesive bonding or sewing as shown in FIG. 5, a zipper 20*a* and other necessary accessories may be further added onto the clothing or vest 2 of this invention. The inflator 1 may be mounted in an inner layer or the first layer 21 of the clothing 2.

As shown in FIG. 11, a clothing or vests 2 is made of two pieces, namely, by further integrating an unique torso panel 2*t* and a shoulder panel 2*c*, forming the 2-piece vest or clothing 2 as another preferred embodiment of the present invention.

Figure 7:
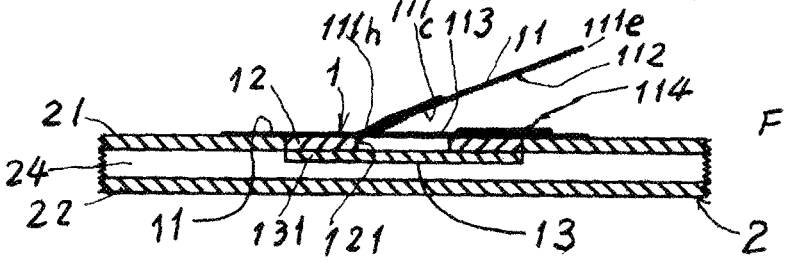
FIG. 7 shows the inflator when opened from FIG. 6.
Figure 8:
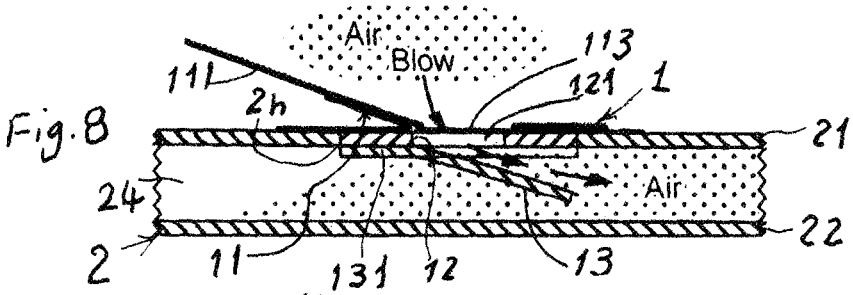
FIG. 8 shows the inflator when blowing air therein.

As shown in FIGS. 6-10, series of operation steps for inflating the clothing 2 of the present invention are described as follows:

1. The covering strap 111 of the cover assembly is downwardly (or inwardly) moved to close the central hole 113 of the cover assembly 11. The check valve 13 is normally restored to close the air port 121 of the air-port member 12 due to self-restoring property of the check valve 13. The air has been deflated from the air chamber 24. This is shown in FIG. 6.
2. The covering strap 111 of the cover assembly 11 is pulled upwardly (or outwardly) to open the central hole 113 in the cover assembly 11. The clothing 2 is ready for inflating air therein as shown in FIG. 7.
3. By blowing air such as by a wearer's mouth or a pump (not shown) into the central hole 113, the air pressure will open the check valve 13 to inflate the air chamber 24 within the clothing. The first layer 21 and the second layer 22 are thus expanded when inflating as shown in FIG. 8. The air inflating in the clothing may make the clothing warm and buoyant for a comfortable and safe wearing by the wearer.
4. The air pressure in the air chamber 24 of the clothing or vest 2 may boost the check valve 13 to well close the port 121 of the air-port member 12, even the covering strap 111 is opened at this time. So, there is no air leakage from the inflator 1 towards the outside of the clothing 2 as shown in FIG. 9.
5. The covering strap 111 is pulled downwardly or inwardly to re-close the hole 113 for dust proof of the clothing 2 as shown in FIG. 10. The cover assembly 11 is closed to preclude any dusts or pollutants entering the hole or port of the inflator. The outer cover assembly 11 is closed to also protect the check valve 13 inside the inflator 1 to prevent unexpected opening of the check valve and to prevent from air leakage from the clothing 2.

For deflating air in the clothing, the cover assembly 11 may be opened and the check valve 13 may be depressed downwardly or inwardly (not shown) by a wearer's finger or by a stick, a needle, a peg or any tool to deflate the air outwardly. The air as evacuated from the clothing 2 may make the clothing 2 thinner to be conveniently folded, stored or shipped.

The present invention is superior to the prior art with the following advantages:

1. The check valve 13 is self-restoring, without the aid of any restoring spring or restoring mechanism, for simplifying the production, and lowering the cost.
2. All elements including check valve 13, air-port member 12 and cover assembly 11 are very thin and light, which may help a smart design of the vest, the clothing and the inflator, thereby increasing their commercial values.

3. All elements in construction of the present invention are so simple, compact, light and easily assembled or fabricated. Such merits may make the present invention easily operated, and maintained in an ergonomic way.
4. The elements, such as the check valve made of rubber, foam or plastic materials, may be easily reclaimed or recycled, beneficial to the environmental protection.

The present invention may be further modified without departing from the spirit and scope of the present invention.

I claim:

1. An inflator for inflatable clothing comprising:

a cover assembly formed on an inflatable clothing;

an air-port member formed under said cover assembly and having an air port formed through said air-port member; and a self-restoring check valve formed as a flat elastic member normally resiliently restored outwardly or upwardly to close said air port in said air-port member for preventing air leakage from an interior of said inflatable clothing when inflated, whereby upon opening of said cover assembly, air is blown into said clothing through said air port in said air-port member to open said check valve for inflating air in said inflatable clothing.

2. An inflator according to claim 1, wherein said cover assembly includes a base fixed or adhered on the inflatable clothing, a covering strap hingedly secured or formed on the base, a central hole formed in said base, a first fastener formed on a bottom of said covering strap, and a second fastener formed on said base, said first fastener engageably fastened with said second fastener for closing said covering strap on said central hole in said base when closing the inflator.

3. An inflator according to claim 2, wherein said base includes an outer annular base portion fixed or adhered on a first layer of said inflatable clothing, and an inner base portion adhered or secured with the air-port member, with said air-port member snugly fixed in a mounting hole formed through a layer of said inflatable clothing.

4. An inflator according to claim 1, wherein said air-port member includes said air port formed through a central portion of the air-port member, and a valve seat disposed around said air port of said air-port member adapted to be closed by said check valve.

5. An inflator according to claim 2, wherein said covering strap of said cover assembly includes: a hinge portion formed on an inner annular portion of said base, a covering portion integrally formed with said hinge portion adapted to cover the central hole and the air port when closing the inflator, and a pulling end formed on an outer end portion of the covering strap to be pulled either upwardly or downwardly for opening or closing the inflator.

6. An inflator according to claim 2, wherein each said fastener is made of a hooked threaded fastener or a looped threaded fastener.

7. An inflator according to claim 1, wherein said self-restoring check valve includes: a fixed portion adhered or secured to the air-port member as projectively positioned under a hinge portion of the covering strap, and a restoring valve portion having an outer or upper flat surface adapted to close or seal a valve seat of the air-port member when closing the check valve.

8. An inflator according to claim 1, wherein said check valve is made of elastomeric materials, including: rubber foam, flexible cellular materials, polychloroprene, plastic sheet or film, silicon rubber sheet or film; having a self-restoring property so that the check valve is normally restored outwardly or upwardly to close the air port of the air-port member.

9. An inflatable clothing includes at least a torso panel and a shoulder panel integrally forming the inflatable clothing; said torso panel including a first layer having a mounting hole formed through the first layer adapted for mounting an inflator in the clothing, a second layer juxtaposed to the first layer to define an air chamber between the first layer and the second layer, a plurality of baffles formed in the air chamber and connected between the first layer and the second layer for forming a solid wall or partition by pressing the first layer and the second layer to form a blockade obstructing or precluding air flow which is filled in the air chamber when inflating the inflator, and a closed edge portion circumferentially formed along a circumference of the torso panel; and said inflator in said clothing comprising:

a cover assembly formed on said inflatable clothing;

an air-port member formed under said cover assembly and having an air port formed through said air-port member; and a self-restoring check valve formed as a flat elastic member normally resiliently restored outwardly or upwardly to close said air port in said air-port member for preventing air leakage from an interior of said inflatable clothing, whereby upon opening of said cover assembly, air is blown into said clothing through said air port in said air-port member to open said check valve for inflating air in said inflatable clothing.

10. An inflatable clothing according to claim 9, wherein said cover assembly of said inflator includes a base fixed or adhered on the inflatable clothing, a covering strap hingedly secured or formed on the base, a central hole formed in said base, a first fastener formed on a bottom of said covering strap, and a second fastener formed on said base, said first fastener engageably fastened with said second fastener for closing said covering strap on said central hole in said base when closing the inflator.

11. An inflatable clothing according to claim 10, wherein said base of said inflator includes an outer annular base portion fixed or adhered on a first layer of said inflatable clothing, and an inner base portion adhered or secured with the air-port member, with said air-port member snugly fixed in a mounting hole formed through a layer of said inflatable clothing.

12. An inflatable clothing according to claim 9, wherein said air-port member of said inflator includes said air port formed through a central portion of the air-port member, and a valve seat disposed around said air port of said air-port member adapted to be closed by said check valve.

13. An inflatable clothing according to claim 10, wherein said covering strap of said cover assembly includes: a hinge portion formed on an inner annular portion of said base, a covering portion integrally formed with said hinge portion adapted to cover the central hole and the air port when closing the inflator, and a pulling end formed on an outer end portion of the covering strap to be pulled either upwardly or downwardly for opening or closing the inflator.

14. An inflatable clothing according to claim 9, wherein said self-restoring check valve includes: a fixed portion adhered or secured to the air-port member as projectively positioned under a hinge portion of the covering strap, and a restoring valve portion having an outer or upper flat surface adapted to close or seal the valve seat of the air-port member when closing the check valve.

15. An inflatable clothing according to claim 9, wherein said check valve is made of elastomeric materials.

16. An inflatable clothing according to claim 10, wherein each said fastener is a hooked thread fastener or a looped thread fastener.

17. An inflatable clothing according to claim 9, wherein said inflatable clothing includes: a vest, a sports wear, a diving vest, a life vest, a jacket, an apparel, a glove, and a footwear; respectively implemented with said inflator.

* * * * *